US007147313B2

(12) United States Patent
Godil et al.

(10) Patent No.: US 7,147,313 B2
(45) Date of Patent: Dec. 12, 2006

(54) REAL TIME DETECTION OF INK STICK JAMS IN PHASING PRINTING SYSTEMS

(75) Inventors: Amin M. Godil, Vancouver, WA (US); Larry E. Hindman, Woodburn, OR (US); Amy B. Thornton, Tigard, OR (US)

(73) Assignee: Xerox Corporation, Stamford, CT (US)

( * ) Notice: Subject to any disclaimer, the term of this patent is extended or adjusted under 35 U.S.C. 154(b) by 131 days.

(21) Appl. No.: 10/749,724

(22) Filed: Dec. 30, 2003

(65) Prior Publication Data

US 2005/0146546 A1 Jul. 7, 2005

(51) Int. Cl.
*B41J 29/38* (2006.01)

(52) U.S. Cl. ..... 347/88; 347/99

(58) Field of Classification Search ..... 347/99, 347/88

See application file for complete search history.

(56) References Cited

U.S. PATENT DOCUMENTS 5,920,332 A * 7/1999 Brooks ..... 347/85
5,992,991 A * 11/1999 Kanemoto et al. ..... 347/88
6,719,413 B1 * 4/2004 Jones ..... 347/84
2002/0180852 A1 * 12/2002 Jones et al. ..... 347/88

* cited by examiner

*Primary Examiner*—Manish S. Shah
*Assistant Examiner*—Laura E. Martin
(74) *Attorney, Agent, or Firm*—Fay, Sharpe, Fagan, Minnich & McKee, LLP

(57) ABSTRACT

A method and system for detecting an ink stick jam in a solid liquid ink phasing delivery system for supplying ink to a printer. The phasing system includes a heater plate disposed to engage a solid ink stick and heat an engaging portion of the ink stick to a liquid phase. A temperature sensing device associated with the heater plate detects the temperature thereof. A control system selectively supplies power to the heater plate. The method comprises supplying a predetermined amount of power through the control system to the heater plate intended to achieve the desired melt rate of the ink stick during a phase change from solid to liquid. The desired melt rate is associated with the predetermined desired temperature of the heater plate. The temperature of the heater plate is sensed with the sensing device during the supply of power thereto. When a sensed temperature of the heater plate varies from the predetermined desired temperature by a selected amount, the supply power is interrupted, whereby heater damage and printer ink starvation can be avoided.

6 Claims, 4 Drawing Sheets

REAL TIME DETECTION OF INK STICK JAMS IN PHASING PRINTING SYSTEMS

BACKGROUND

The present exemplary embodiments relate to printing systems and, in particular, printing devices which utilize a supply of colored inks to be communicated to a print head for document printing. More particularly, the present embodiments utilize solid ink sticks as the supply ink, which must be heated to a liquid form before being capable of communication to the print head. Such systems are commercially available under the PHASER® mark from Xerox Corporation.

The present embodiments concern the structure, control system and operation methods of the heater element for causing a phase change in the solid ink supply to a liquid form capable of fluid communication to a print head for document printing.

The basic operation of such phasing print systems comprises the melting of a solid ink stick, its communication to a reservoir for interim storage, and then a supply process from the reservoir to a print head for printing of a document. One object of the control strategy is to avoid the printing system running out of ink while trying to print, because such an event can be a catastrophic failure to the system. Prior known systems will typically supply a measuring device in the reservoir to monitor ink levels therein. When the ink drops below a certain level due to normal usage, then the ink supply control system would melt more of the solid ink supply until the reservoir would refill to the desired level. The steps of asking for more ink, turning on the melter to melt the solid ink, delivering the ink to the reservoir to a desired level and then turning the heater off is commonly referred to as an "ink melt duty cycle." It is an operating feature of such systems that as the frequency of melt duty cycle changes, the flow rate characteristics of the heating system will correspondingly change. For higher frequency duty cycles, the melt rate goes up; for lower frequencies, the melt rate goes down.

Conventional systems used a fixed applied power supply to the heater that was intended to provide a desired melt rate into a reservoir that was relatively large (approximately twenty-two grams of ink could be held therein). The ink level detector would initiate an ink melt duty cycle when the measuring device indicated that the ink level had dropped below a predetermined level. In the situation where an ink stick jam has occurred, i.e., the solid ink stick is obstructed from sliding down the ink loader tray to engagement with the heater, the continued supply of energy to the heater would not be able to melt the solid ink stick, because the stick was spaced from the heater itself. If the reservoir were to actually run dry, the printing system would suffer a catastrophic failure and would be unable to print. In addition, the continued application of the power to the elements of the heater could cause high temperature damage to the heater itself and to adjacent componentary. The print head could become clogged requiring an expensive maintenance repair with significant printer down time.

In order to avoid the possibility of running out of ink, conventional systems employed a timer which would time out a preselected amount of time that was assumed would not be enough time to let the reservoir run out, even for maximum printing usage of that color. If the measuring device did not indicate a refill of the reservoir during the time out period, the controller would disable further printing and the application of energy to the heater, thus assuming an ink stick jam. The system would disable further heating after the elapse of the timer time-out cycle. The ink stick jam could then be identified and corrected, and the reservoir would then have to be refilled before printing could recommence.

The present exemplary embodiments are intended to employ a smaller reservoir of approximately five to six grams of ink. Smaller reservoirs present an advantage of not having to heat larger ink portions to remain liquid in the print head. In a maximum fill printing operation, the smaller reservoirs can be drained relatively quickly so that a time-out operation before assessing an ink stick jam presents an unacceptable risk of a reservoir going dry and consequential damage to the print head and the jets therein. There is a need for a system which can provide a real time indication of an ink stick jam to provide for improved operating control of system operation and improved safety against a catastrophic failure of a dried out reservoir occurring during a print operation. The present exemplary embodiments satisfy this need as well as others to provide a method and assembly for detecting an ink stick jam in a phasing printing system in real time. However, it is to be appreciated that the present exemplary embodiments are also amenable to other like applications where the supply of power to the heating element needs to be interrupted relatively soon due to the failure to supply an item intended to be heated by the heater element.

BRIEF DESCRIPTION

A method and a system is provided for detecting an ink stick jam in a solid-to-liquid ink phasing delivery system for supplying ink to a printer. The phasing system includes a heater plate disposed to engage a solid ink stick and heat an engaging portion of the ink stick to a liquid phase, a temperature sensing device associated with the heater plate for detecting a temperature thereof, and a control system for selectively supplying power to the heater plate. The method comprises supplying a predetermined amount of power through the control system to the heater plate intended to achieve a desired melt rate of the ink stick for a phase change from solid to liquid. The desired melt rate is associated with a predetermined desired temperature of the heater plate. The temperature of the heater plate is sensed with the sensing device during the supply of power thereto. When the sensed temperature of the heater plate varies from the predetermined desired temperature by a selected amount indicating a possible ink stick jam, the supply power is interrupted whereby heater damage and printer ink starvation can be avoided.

DETAILED DESCRIPTION

Figure 1:
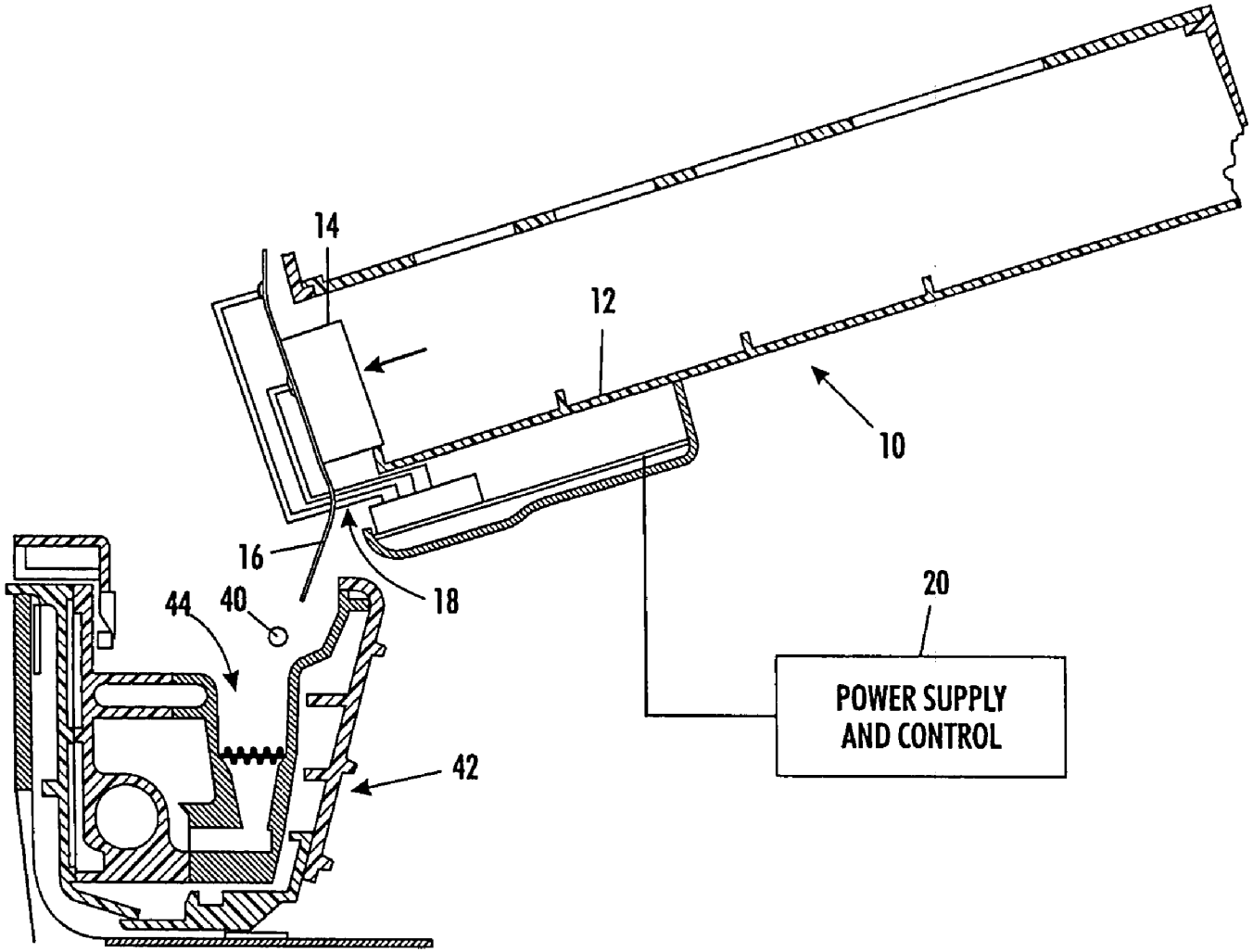
FIG. 1 is a cross-sectional view in partial section of a print head, ink stick and ink loader assembly, and power supply and control system therefor.

With reference to FIG. 1, the basic elements of an ink supply system in an ink "phase-changing" printing system can be seen. Ink loader assembly 10 includes a tray 12 for holding a solid phase ink stick 14. An ink melt heater 16 is disposed at an open end 18 of the tray to contact the ink stick and to allow for egress of liquid phase ink during heating from the tray 10. The heating plate 16 receives its heating energy from a power supply and control system 20. The heating element includes an assembly with resistance traces thereon so that electrical energy supplied thereto can be converted to heat energy.

FIG. 1 is intended to illustrate an accurate positional disposition of the ink stick in the tray 11 to illustrate that the ink stick is urged against the heater plate 16 by both gravity and some other applied force means such as a spring bias (not shown) or the like. If, as the ink stick 14 is urged towards the heating plate 16, some obstruction causes it to be unable to slide into engaging contact, the heater plate 16 can rise to a temperature substantially in excess of the desired melt rate temperature due to the absence of a cooling effect of a melting ink stick against it.

Ink stick jams can occur due to the cracking of the ink stick itself overtime and the falling of particles from the stick on to the glide surfaces of the tray 12. Alternatively, the stick 14 could somehow be moved out of the track path or become skewed in the path to limit its ability to slide down the tray. The door (not shown) which allows the refilling of a solid ink stick into the tray could be detached and also could obstruct the ink stick's movement. Other causes could be dirt falling into the tray or any other causes of friction between the tray glide surface and the stick. However, whatever the cause, the failure of the ink stick to engage the heater plate 16 can cause overheating damage to the plate, and when such a lack of ink supply causes the print head assembly to run out of ink, the failure can be catastrophic.

FIG. 1 shows an ink drip 40 falling from the tray 10 and the heating element 16 assembly from ink drip point 36 into a print head assembly 42. Print head assembly 42 comprises a reservoir 44 to receive the melted ink and to communicate with the ink through nozzles (not shown) within the print head assembly for printing on a document. The reservoir is intended to hold approximately five to six grams of melted ink and is accordingly heated to maintain the ink stored therein in liquid form.

Figure 2:
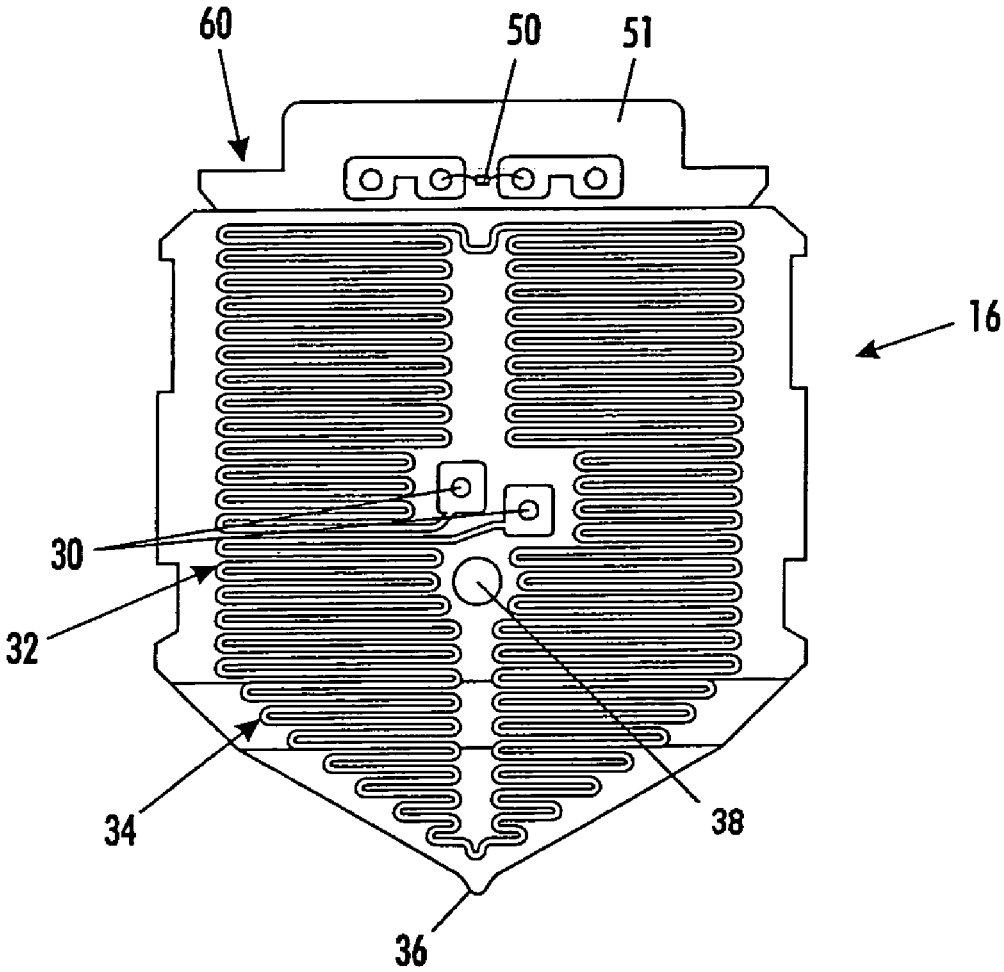
FIG. 2 is an end view of one embodiment of a heater melt plate.

With particular reference to FIG. 2, power pads 30 connect wires (not shown) from the power supply to the heating plate 16. The plate includes a first portion 32 disposed to engage the ink stick and phase change the solid ink stick to a liquid. A heated liquid ink zone 34 then allows the liquid ink to flow to an ink drip point 36. It should be appreciated that the embodiment shown in FIG. 2 comprises the side of the heater element having the heat traces shown. The ink stick will actually contact the element comprising a metallic heat plate on a back side from that shown in FIG. 2. A rivet hole 38 is used to attach the assembly of heat traces to the metallic plate. A temperature sensing device 50 is associated with the heating plate 16 for detecting a temperature thereof. Although numerous temperature sensing devices are available, such as thermometers, electrical sensors, chemical sensors, or the like, in this presently preferred embodiment a thermistor 50 mounted on a depending portion 51 and in direct communication with the control system 20 effectively detects a signal representative of the temperature of the heater.

The present preferred embodiment comprises an algorithm that monitors the heating plate temperature to identify a rapid rise in the heating plate temperature above the intended melting temperature for the heating plate 16 during an ink melt duty cycle when the ink stick is properly engaged in the heating assembly.

In order to realize the desired melting temperature of the heater 16 when the ink stick 14 is engaged against the heater, a predetermined amount of power is applied to the heating traces of the heater assembly. Approximately seventy point five watts of energy at eighty seven volts is supplied. Such an energy supply will heat an engaging ink stick to approximately 110° C., which can be detected by the thermistor 50 with a measured temperature at the fin portion 51 of approximately 120° C. The ink melt temperature is around 100° C., so the desired heating temperature will result in the desired ink flow rate during an ink melt duty cycle.

In the event of an ink stick jam, the engaging ink stick will no longer have a cooling effect on the heater 16 so that the fin portion 51 may quickly rise to a higher temperature than the desired temperature of a melt duty cycle. The higher temperature is indicative of non-engagement between the heater 16 and the ink stick 14. For example, if the thermistor 50 were to indicate that the heater 16 had risen to approximately 150° C., the control system would interpret such a rapid and increased rise in temperature as a result of the absence of an engaging ink stick and would immediately interrupt the application of power to the heater 16. The rapid rise in temperature of the heater is such that the recognition of a non-engaging ink stick can be made by the control system 20 in essentially real time at the outset of a new ink melt duty cycle., i.e., there is no need for a timer as in the prior art to permit a selected run off time for the accumulated ink in the reservoir 44. The variation from the desired melt temperature that is indicative of an ink stick jam is selective but in the subject preferred embodiment is approximately 150° C.

The presently disclosed real time method of detecting an ink stick jam allows an associated printer system to turn off power to the heater 16 to prevent heater damage due to over heating, prevent uncontrollable extrusion of a possible jammed ink stick due to over exposure to the undesirably high temperatures, the prevention of print head 42 ink starvation, and timely notification to a user of the fault as soon as it occurs.

Figure 3:
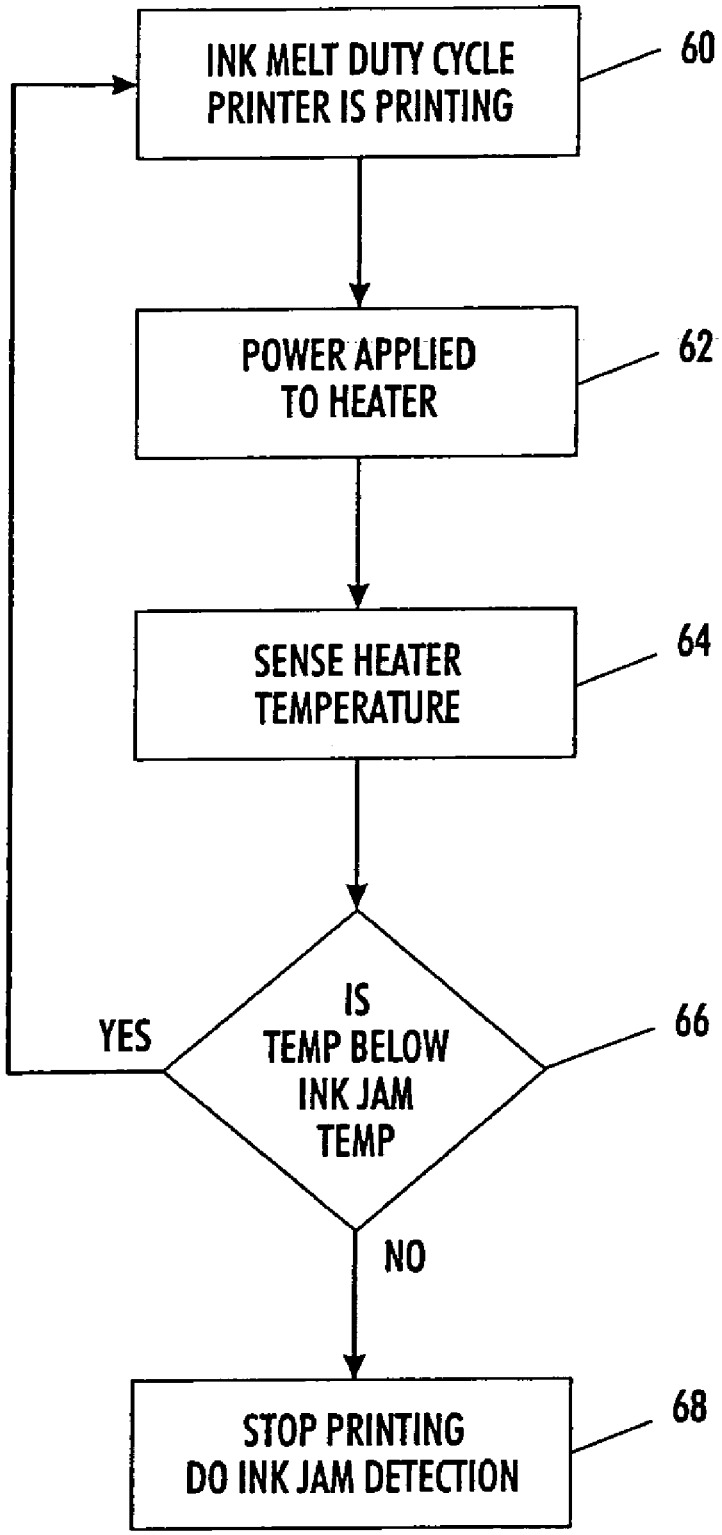
FIG. 3 is a flow chart of the control steps for interrupting applied power to the ink melt heater.

With reference to FIG. 3, the implemented algorithm and operational method of one of the preferred embodiments is shown. As an ink melt duty cycle is initiated 60 for document printing, power is supplied 62 to the heater 16. The temperature sensing device 50 associated with the heater 16 will provide 64 a signal to the control system 20 representative of the temperature of the heater 16. If the control system recognizes 66 that the sensed temperature is below a preselected temperature indicating that the heater is operating normally within the melt duty cycle, then the printer printing may continue. If the temperature is not below the predetermined temperature, i.e., the temperature indicates that an ink jam may be occurring, then the printing is stopped 68 and an operator signaled to check for an ink jam in the printing system.

Figure 4:
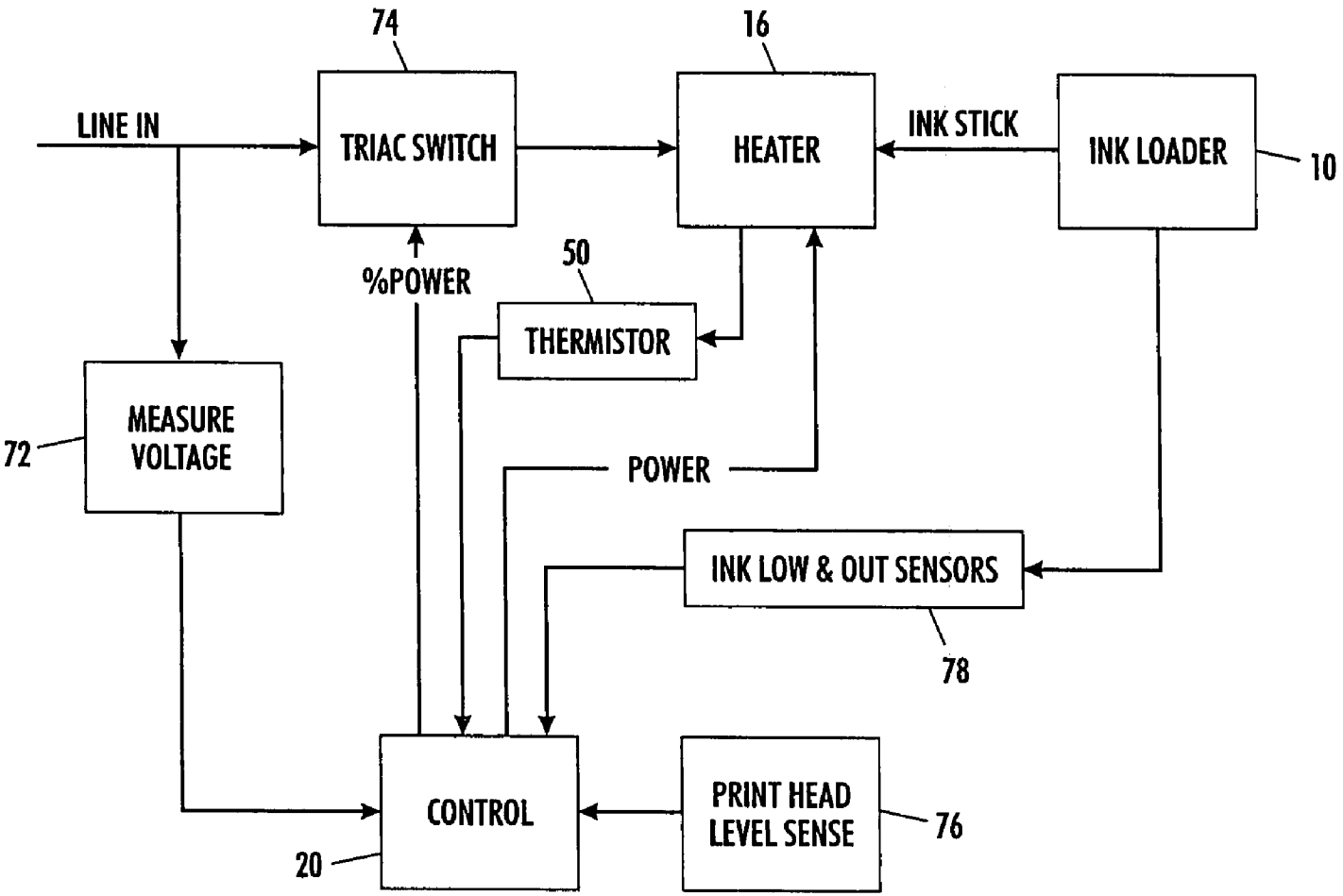
FIG. 4 is an ink melt heater power control block diagram of a system formed in accordance with the subject preferred embodiments.

FIG. 4 is a block diagram of an ink melt heater power control system formed in accordance with the present embodiment. In this application, the control system 20 controls the application of power to the heater 16 through a switch 74 so that the power to the heater can be interrupted when the thermistor 50 senses a temperature indicative of a possible ink stick jam. In this embodiment, a print head level sensor 76 senses the ink level in the reservoir 42 to determine when an ink melt duty cycle should be initiated. A measure voltage block 78 reduces the line voltage to the desired voltages to achieve the desired power applications to the heater 16. The ink loader may also include ink low and out sensors 78.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A method of detecting an ink stick jam in a phasing printing system having an ink loader configured to hold a solid ink stick and wherein the stick is disposed for engagement with a heater for heating the solid ink stick to a liquid for communication of liquid ink to a print head for document printing, comprising:

applying a predetermined amount of power to the heater for melting the solid ink stick, wherein the predetermined amount of power will generate a melting temperature of the heater when the ink stick is engaging the heater for the communication of the liquid ink to a reservoir associated with the print head;

monitoring the temperature of the heater during the applying; and, when the heater is determined to have a temperature selectively higher than the melting temperature and indicative of non-engagement between the heater and the ink stick representative of the ink stick jam, interrupting the applying of the power.

2. The method as defined in claim 1 wherein the applying comprises generating the melting temperature to be about one hundred ten degrees Centigrade and the temperature higher than the melting temperature is about one hundred fifty degrees Centigrade.

3. The method as defined in claim 1 wherein the monitoring comprises disposing a thermistor at the heater for generating a signal representative of heater temperature.

4. An ink stick jam detection system in an ink phasing printing assembly wherein a solid ink stick is heated to a liquid phase for communication to a print head for document printing, comprising:

a tray for holding the solid ink stick and having an open end for egress of liquid phase ink during heating;

a heater disposed at the open end to contact the ink stick and wherein the tray is disposed to urge the ink stick into contact with the heater and direct the liquid phase ink to a downstream reservoir;

a power supply for supplying energy to the heater;

a control circuit for adjusting the supplied energy; and, a sensor for sensing a parameter representative of heater temperature at the heater wherein when the sensor senses the heater temperature to be indicative of non-contact between the ink stick and the heater representative of the ink stick jam, the control circuit interrupts the supply of energy to the heater.

5. The system as claimed in claim 4 wherein the sensor comprises a thermistor disposed on the heater and in communication with the control circuit.

6. A method of detecting an ink stick jam in a solid to liquid ink phasing delivery system for supplying ink to a printer, wherein the phasing system includes a heater plate disposed to engage a solid ink stick and heat an engaging portion of the ink stick to a liquid phase, a temperature sensing device associated with the heater plate for detecting a temperature thereof and a control system for selectively supplying power to the heater plate, the method comprising:

supplying a predetermined amount of power through the control system to the heater plate intended to achieve a desired melt rate of the ink stick during a phase change from solid to liquid, the desired melt rate being associated with a predetermined desired temperature of the heater plate;

sensing the temperature of the heater plate with the sensing device during the supply of power thereto;

when the sensed temperature of the heater plate varies from the predetermined desired temperature by a selected amount indicative of non-engagement of the ink stick with the heater plate representative of the ink stick jam, interrupting the supplied power whereby heater damage and printer ink starvation can be avoided.

* * * * *